US005568782A

United States Patent [19]

Moody

[11] Patent Number: 5,568,782

[45] Date of Patent: Oct. 29, 1996

[54] BI-MODAL ELASTOMERIC EJECTOR

[75] Inventor: Paul E. Moody, Barrington, R.I.

[73] Assignee: The United States of America as represented by the Secretary of the Navy, Washington, D.C.

[21] Appl. No.: 505,714

[22] Filed: Jul. 31, 1995

[51] Int. Cl.[6] ..... B63B 1/00

[52] U.S. Cl. ..... 114/238; 114/319; 417/474

[58] Field of Search ..... 114/238, 318, 114/319; 89/1.809, 1.81, 1.816, 1.819; 124/69–73; 42/1.14; 417/474

[56] References Cited

U.S. PATENT DOCUMENTS

| | | | |
|---|---|---|---|
| 4,848,210 | 7/1989 | Bissonnette | 114/319 |
| 5,200,572 | 4/1993 | Bissonnette et al. | 89/1.81 |
| 5,410,978 | 5/1995 | Waclawik et al. | 114/319 |
| 5,438,948 | 8/1995 | Moody | 114/238 |

*Primary Examiner*—Jesus D. Sotelo
*Attorney, Agent, or Firm*—Michael J. McGowan; James M. Kasischke; Prithvi C. Lall

[57] ABSTRACT

An article ejector for use in marine applications which uses elastomeric devices for storing elastomeric energy to eject an article. Pressurized water is used for causing the devices to expand and store elastomeric energy at levels for ejecting the article at one of at least two velocities. A valve is provided for releasing the water and causing the elastomeric devices to release the stored elastomeric energy and move the water at a high velocity and force. The devices, water and valve are contained in a support housing connected with a launch tube, wherein upon the release of the stored elastomeric energy, the elastomeric devices move the water through the support housing and into the launch tube for ejecting the article at one of the at least two velocities.

12 Claims, 3 Drawing Sheets

BI-MODAL ELASTOMERIC EJECTOR

STATEMENT OF GOVERNMENT INTEREST

The invention described herein may be manufactured and used by or for the Government of the United States of America for governmental purposes without the payment of any royalties thereon or therefor.

CROSS REFERENCE TO RELATED PATENT APPLICATIONS

The instant application is related to a co-pending U.S. patent application entitled AN ELASTOMERIC PUMP (Navy Case No. 75308, having the same filing date.

BACKGROUND OF THE INVENTION (1) Field of the Invention

This invention relates to submarine ejection devices, and more particularly, to an elastomeric ejection device providing variable ejection velocities for ejecting an article such as a missile from a marine vessel.

(2) Description of the Prior Art The launching of missiles, rockets or other articles in marine applications, such as from submarines or ships is typically accomplished by directing fluid under high pressure against the article to be launched. Pressure can be generated through hydraulic systems and/or movable pistons or ram pumps which cause a fluid, usually sea water, to be placed under high pressure. Based on the pressure generated, variable speeds can be produced at which the missile or other article is launched. In the prior art a ram pump design is used for ejecting small devices from a submarine.

Typical shortcomings of current devices for launching missiles or other articles, such as those discussed below, lie in the fact that such launching mechanisms are large, inefficiently consuming space, and loud, threatening covert operations.

The prior art includes a launching device which uses elastomeric energy. Such a device functions by pumping sea water on one side of an elastomer thereby distorting it. When the high pressure water is ported to a launcher, the elastomeric energy pushes water through the system to effect a launch. The problems with such devices is that in order to utilize the optimum stress/strain relationship of an elastomer, each elastomeric shape must be configured to provide a specific device exit velocity. As a result of a marine vessel's requirement to eject devices at two different exit velocities, two elastomeric launcher/ejection systems have been required, one for each velocity. The need for two launch ejection systems results in unacceptable and inefficient space consumption within the vessel.

U.S. Pat. No. 4,527,502 to Schmitt discloses an expelling mechanism for discharge tubes and drain tubes of submarines. The expelling mechanism can be adapted for use in submarines for ejecting a weapon by compressed air and includes a chamber formed with an outlet opening. The chamber is adapted to communicate selectively with a storage container holding compressed gas wherein a discharge valve may be adjusted for controlling velocity via a hydraulic control device. The hydraulic control device includes a cylinder adapted to be filled with hydraulic fluid and a piston reciprocally movable along a stroke within the cylinder.

The cylinder is partitioned into two cylinder chambers via an overflow channel which establishes communication between the cylinder channels and a connecting device connecting the discharge valve with the hydraulic control device. The outlet opening and the overflow channel have cross sections which are variable in dependence of the stroke, respectively, so that the outlet opening increases as the discharge valve moves in the opening direction. The opening velocity of the discharge valve may be controlled, and different respective cross-sections of the overflow channel may be set in dependence of the stroke.

Because a cylinder is used which is activated via a hydraulic mechanism, the Schmitt system is louder than desirable for some covert operations. Also, the Schmitt system is directed to discharging drainage tubes and is probably not powerful enough for launching missiles or the like.

U.S. Pat. No. 5,210,369 to Cassidy discloses a self-actuating slide valve system for launching an article in a fluid environment. An interior channel, in which the article is positioned, is provided with first and second openings in its radial walls for allowing the passage of pressurized fluid into the interior channel. The first opening is located at least partially behind a tail end of the article and the second opening is located forward of the first opening. A sleeve is slidably fitted within a portion of the interior channel and around at least a portion of the article.

The sleeve is movable between at least a first and second position. In the first position, the sleeve prevents the pressurized fluid from entering the interior channel through the first opening. In the second position, the sleeve allows the pressurized fluid to enter the interior channel through the first opening whereby the pressurized fluid can act on the tail end of the article to launch same through an axial opening of the interior channel. The interior channel, the sleeve and the circumferential extremity define a holding volume in communication with the second opening that is adapted to be supplied with the pressurized fluid to maintain the sleeve in its first position and then evacuated of the pressurized fluid to permit the sleeve to attain its second position.

Because a slidable sleeve is used in Cassidy, similar to a cylinder, substantial space is required to achieve the necessary stroke and because of the hydraulics involved, certain covert operations can be threatened.

U.S. Pat. No. 3,857,321 to Cohen discloses a submarine missile launch system. The launch system includes a launch tunnel connecting a launching tube and the outer skin of the vessel through which the missile is adapted to pass. The tunnel is provided with a liner formed from a matrix of resilient finger-like inward projections separated by longitudinal and transverse grooves. The exit end of the matrix is provided with radial inward seal rings adapted to flexibly engage the missile. The fingers are selectively provided with sensors monitoring the movement of the missile, which sensors control a hydraulic counter-torquing system regulating the ejection of the missile. The system shown in Cohen is designed to function with launch systems similar to as described above.

There exists, therefore, a need for an ejection device for use in marine applications which efficiently and covertly uses elastomeric energy for moving fluid under high pressure at variable velocities for use in launching an article.

SUMMARY OF THE INVENTION

The primary object of this invention is to provide an ejection device for use in marine applications which is effective for producing variable speed ejections and which is efficiently sized.

Another object of this invention is to provide an ejection device for use in marine applications which incorporates the use of elastomeric energy.

Still another object of this invention is to provide an ejection device for use in marine applications which is economic and allows for covert operation via the quiet nature of elastomeric devices.

Still another object of this invention is to provide an ejection device for use in marine applications which uses elastomeric energy for launching at two velocities and is capable of being back and forward fit on ships.

The foregoing objects are obtained by the bi-modal elastomeric ejector of the present invention which includes at least one elastomeric storage device for storing elastomeric energy to eject the article at one of at least two velocities. A provided fluid is adapted to be directed under pressure into the region within the elastomeric device to load the elastomeric device to store elastomeric energy. A release is provided for releasing the fluid and for causing the elastomeric device to release stored elastomeric energy. These components are positioned within a housing connected to an article guide. Upon release of the stored elastomeric energy, the fluid is directed behind the article guide to eject the article at one of two velocities from the article guide.

In one embodiment of the invention, the elastomeric storage device includes first and second elastomeric devices positioned in the housing. The second elastomeric device is adapted to store more energy than the first elastomeric device for moving the loading means and article at a higher velocity than the first elastomeric device. The first and second elastomeric devices are preferably cylindrically shaped and positioned in the housing so as to allow for expansion and compression of the elastomeric device to allow storage and release of energy therefrom. In this embodiment, the first and second elastomeric devices are separated by a mid-piece. The elastomeric devices may be in the form of elastomeric rings, wherein the second ring has a thicker wall than the first ring.

The details of the present invention are set out in the following description and drawings wherein like reference characters depict like elements.

BRIEF DESCRIPTION OF THE DRAWINGS

A more complete understanding of the invention and many of the attendant advantages thereto will be readily appreciated as the invention becomes better understood by reference to the following detailed description when considered in conjunction with the accompanying drawings wherein.

DETAILED DESCRIPTION OF THE PREFERRED EMBODIMENT

Figure 1:
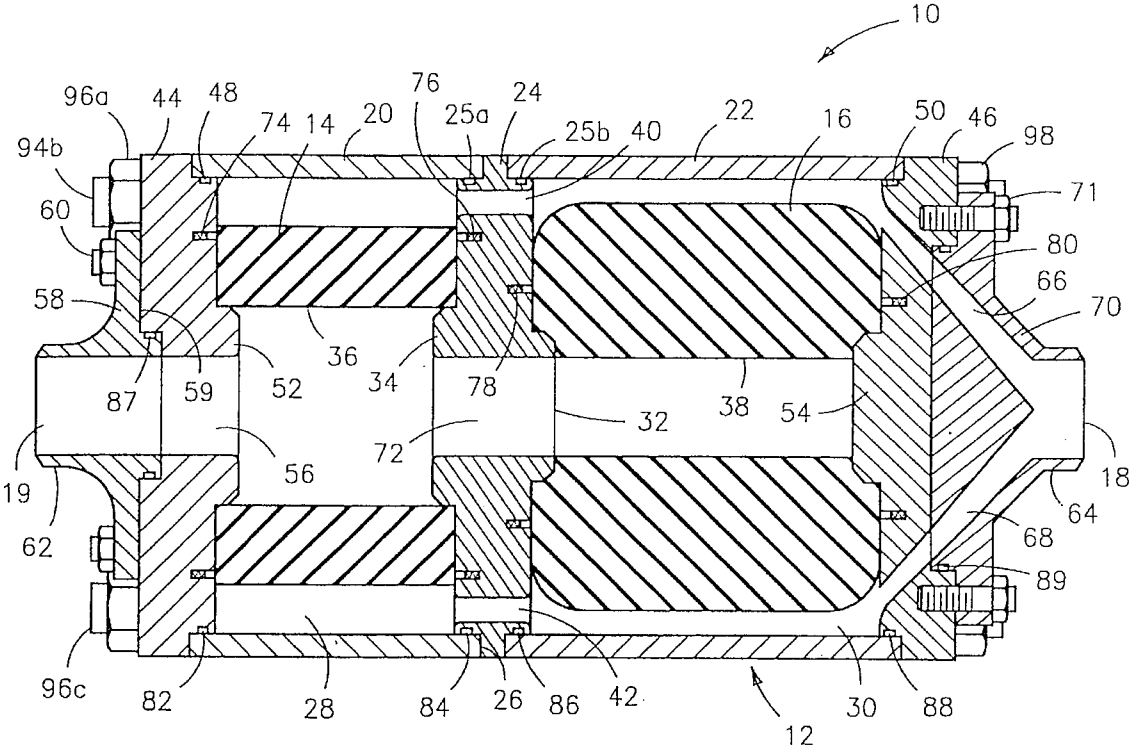
FIG. 1 is a side elevational and partially cross-sectional view of the ejector device of the present invention taken along line 1—1 of FIG. 2.

Referring now to the drawings in detail, there is shown in FIG. 1 an elevational and cross-sectional view of the ejector of the present invention, designated generally as 10. Ejector 10 generally includes a support housing 12, a first energy storing elastomeric ring 14, a second energy storing elastomeric ring 16 and ports 18 and 19.

Support housing 12 includes a first cylindrical portion 20 and a second cylindrical portion 22. Cylindrical portions 20 and 22 are connected via a central cylindrical mid piece 24. Cylindrical portion 20 is preferably shorter in length than cylindrical portion 22. Cylindrical mid piece 24 includes two cylindrical outer support surfaces 25*a* and 25*b* which are separated by a ridge 26. The support surfaces of the mid piece 24 are adapted to engage the inner edges of each cylindrical portion 20 and 22, such that the cylindrical portions are separated via ridge 26. Mid piece 24 partially traverses the hollow space enclosed by cylindrical portions 20 and 22, dividing the ejector into chambers 28 and 30. Mid piece 24 has an opening 32 extending through the center thereof for communicating portions of chambers 28 and 30 enclosed by rings 14 and 16. Also, mid piece 24 has a central flange 34 extending axially from both sides of mid piece 24 wherein flange 34 is adapted to engage the inner surfaces 36 and 38 of elastomeric rings 14 and 16, respectively. The portion of flange 34 which engages ring 16 is angled approximately 45° from the horizontal for engaging a similarly angled edge of ring 16 on inner surface 38. The portion of flange 34 which engages ring 14 is substantially horizontal and includes a 45° chamfer. Mid piece 24 also includes a plurality of slots such as slots 40 and 42 positioned substantially adjacent the periphery thereof which slots provide communication between portions of chambers 28 and 30 located outside each of elastomeric rings 14 and 16, respectively.

Cylindrical portions 20 and 22 are supported on their outside ends via rectangular end caps 44 and 46, respectively, having diagonal lengths wider than the circumference of cylindrical portions 20 and 22 such that the corners thereof extend beyond the circumference of the cylindrical portions. End caps 44 and 46 each include axially extending cylindrical support surfaces 48 and 50, respectively, having smaller outside diameters than the inside diameters of cylindrical portions 20 and 22 which function to support the outside ends of cylindrical portions 20 and 22, respectively. End cap 44 also includes an axially and inwardly extending cylindrical flange 52 for engaging the inner surface of ring 14 and end cap 46 includes an axially extending cylindrical flange 54 for engaging an inner surface 38 of ring 16. The corner of flange 54 is angled approximately 45° from the horizontal and engages a similarly angled edge of inner surface 38 of ring 16, opposite flange 34. The corner of flange 52 is chamfered 45° for safety purposes. Flange 52 engages inner surface 36 on a substantially straight surface. End cap 44 includes an opening 56 through the center thereof which leads to input/output port 19. Preferably, end cap 44 engages a pipe connector 58 which also includes input/output port 19. Pipe connector 58 has a flat portion 59 connected to end cap 44 via fasteners 60 and a central cylindrical and axially extending portion 62 for connection with a pipe.

Figure 2:
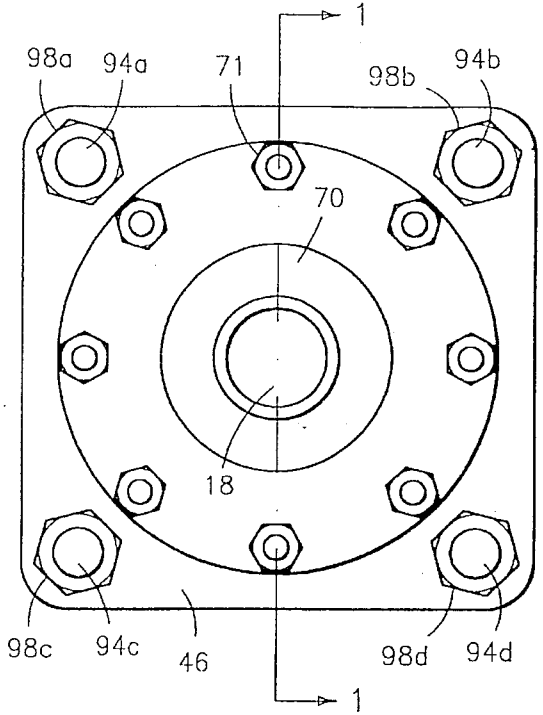
FIG. 2 is an end view of the ejector device shown in FIG. 1.

End cap 46 is a rectangular plate, as shown more clearly in FIG. 2, connected to flange 70 which has an axially extending cylindrical portion 64 defining port 18. Axially extending portion 64 leads port 18 to two or more diverging channels 66 and 68, defined in flange 70 and continuing into cap 46, and in fluid communication with outer portions of chambers 28 and 30. Accordingly, the channels extend from port 18 in flange 70, through end cap 46 and into a portion of chamber 30 outside ring 16. Channels 66 and 68 and port 18 function to direct water to and from a water source, (such as the sea) providing pressure relief when the pressure is caused to build at the interior of rings 14 and 16, i.e., allowing water to escape from the outer portions of chambers 28 and 30 upon the expansion of rings 14 and 16. Flange 70 is configured to continue channels 66 and 68 from end cap 46 such that water flows smoothly to and from port 18 and end cap 46. Flange 70 is secured to end cap 46 via a plurality of conventional fastening means such as bolts 71, arranged circularly as shown in FIG. 2.

Figure 4:
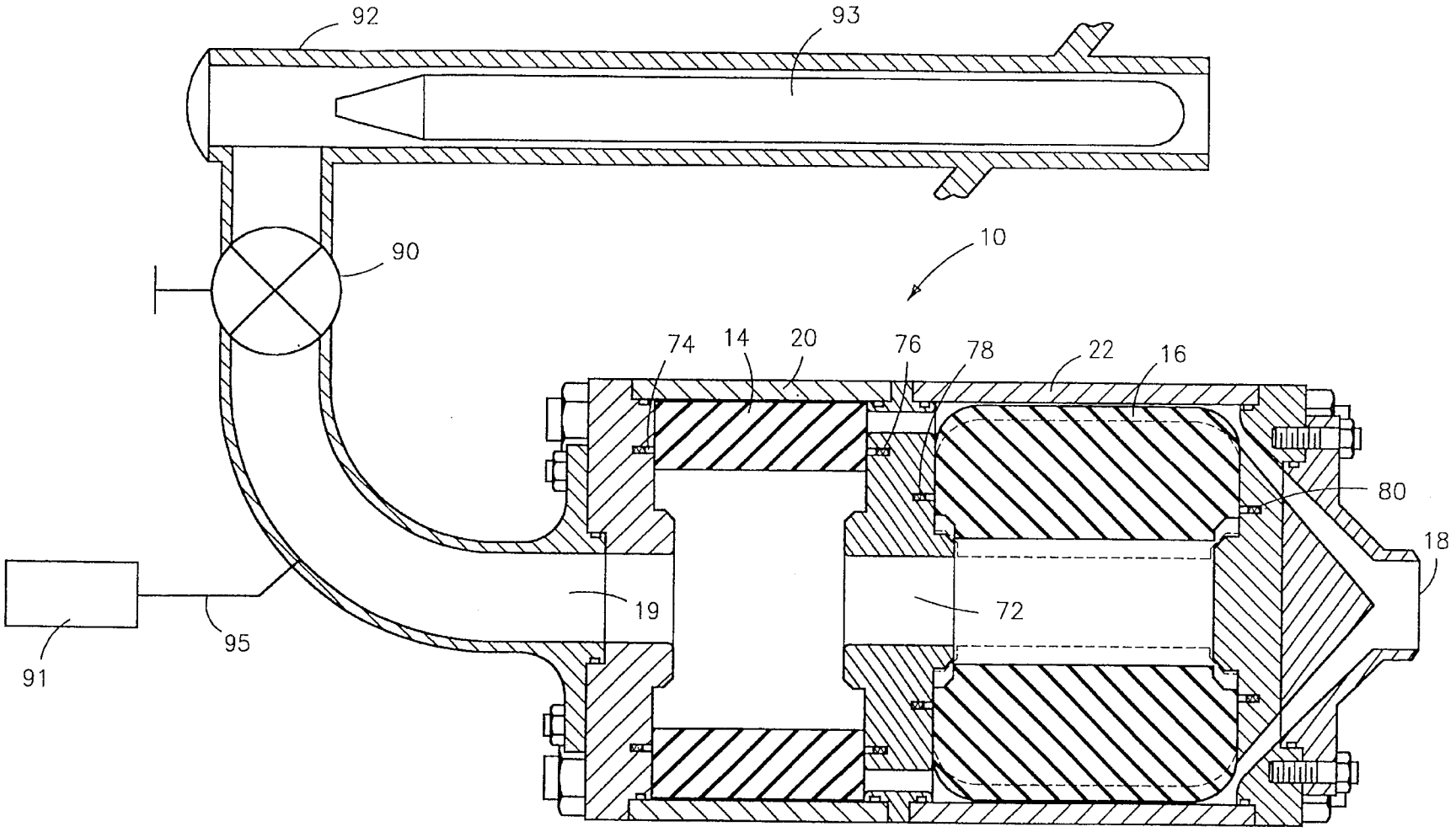
FIG. 4 is a side elevational and partially cross-sectional view of the ejector device of FIG. 1 with its elastomeric devices shown in an expanded position and being attached to a launching tube.

Elastomeric ring 14 is secured in ejector 10 between end cap 44 and mid piece 24. As discussed earlier, flange 34 of mid piece 24 and flange 52 of end cap 44 engage the inner surface edges of ring 14. A substantial portion of the inner surface of ring 14, however, is exposed to a channel 72 extending through ejector 10 due to the fact that flanges 34 and 52 engage ring 14 only at its edges. End cap 44 and mid piece 24 are spaced longitudinally such that ring 14 is securely held therebetween in its unexpanded state. Ring 14 loosens upon expanding vertically, wherein its width minimally decreases. As shown in FIG. 1, in the unexpanded state, ring 14 rests against flanges 34 and 52, of mid piece 24 and end cap 44, respectively. When pressure is introduced into channel 72, ring 14 expands upwardly to the inner cylindrical surface of cylindrical portion 20, as shown in FIG. 4. Because ring 16 is larger and less elastic than ring 14, ring 16 expands only minimally at the point where just enough pressure is supplied to expand ring 14 maximally. End cap 44 and mid piece 24 include circular and axially positioned grooves therein for receiving sealing rings 74 and 76. Sealing rings 74 and 76 isolate channel 72, from the portion of chamber 28 adjacent the outside of ring 14. Such isolation is sufficient to cause a pressure differential between the channel 72 and outer chamber portion when high pressure is introduced to channel 72, forcing ring 14 to expand. Sea water adjacent the outer portion of ring 14 is vented via slots 40 and 42 from outer portion of chamber 28 to outer portion of chamber 30, into channels 66 and 68 and through port 18.

The design of ring 16 is substantially the same as the design of ring 14. However, ring 16 is substantially longer in length and has substantially thicker wall portions than ring 14. Accordingly, higher pressure is required for expanding ring 16 outwardly to the inner wall of cylindrical portion 22. Similar to ring 14, a substantial portion of inner surface 38 is exposed to channel 72 for receiving the pressure created therein. Mid piece 24 and end cap 46 are spaced so as to secure ring 16 therebetween yet allow for expansion upwardly toward cylindrical portion 22 during pressurization. Similar to the ring 14 description, mid piece 24 and end cap 46 each include sealing rings 78 and 80, respectively, which function to isolate the pressure adjacent the outer surface of ring 16 from the higher pressure in channel 72. Because greater pressure is required to expand ring 16 as opposed to ring 14, ring 14 maximally expands during the expansion of ring 16.

Because rings 14 and 16 are completely contained within housing 12, i.e., cylindrical portions 20 and 22, respectively, complete failure of the rings would not result in a safety hazard to the vessel, ship or the like.

Sealing rings 74, 76, 78 and 80 are spring loaded so as to maintain sealing pressure against their respective elastomeric ring for maintaining isolation of pressure in chambers 28 and 30 at the outer portions of the rings from the higher pressure within channel 72, during the upward expansion and length shortening of the rings.

In addition to the spring loaded sealing rings, housing 12 includes additional seals between the cylindrical portions and end plates and between the cylindrical portions and mid piece for maintaining pressure in the housing. The seals are shown in FIG. 1 and designated as 82, 84, 86 and 88. Additionally, seal 87 is positioned between end cap 44 and pipe connector 58 and seal 89 is positioned between end cap 46 and flange 70.

Referring to FIGS. 1 and 2, the entire structure, including cylindrical portions 20 and 22, mid piece 24, end caps 44 and 46, and rings 14 and 16, is held together longitudinally primarily via tie rods **94*a*–94*d*, end nuts 96*a*–96*d* (96*b* and 96*d* not shown) and end nuts 98*a*–98*d*. The tie rods 94*a*–94*d* extend the length of ejector 10, through the corners of end plates 44 and 46. The tie rods 94*a*–94*d* connect the end plates 44 and 46, extending adjacent to the outside surface of cylindrical portions 20 and 22, and are secured via the nuts 96 and 98 to end plates 44 and 46**, respectively. The tie rods are used to hold the entire assembly together.

As a result of the compact construction described above, the space consumed by the present invention is substantially less than devices shown in the prior art.

As an alternative to the embodiment shown, it may be desirable to taper the end caps 44 and 46, and mid piece 24, so that as the elastomeric rings expand and the length of each decreases, the clearance between the spring loaded seals 74, 76, 78, and 80 and the elastomeric rings 14 and 16 remains relatively constant.

Figure 3:
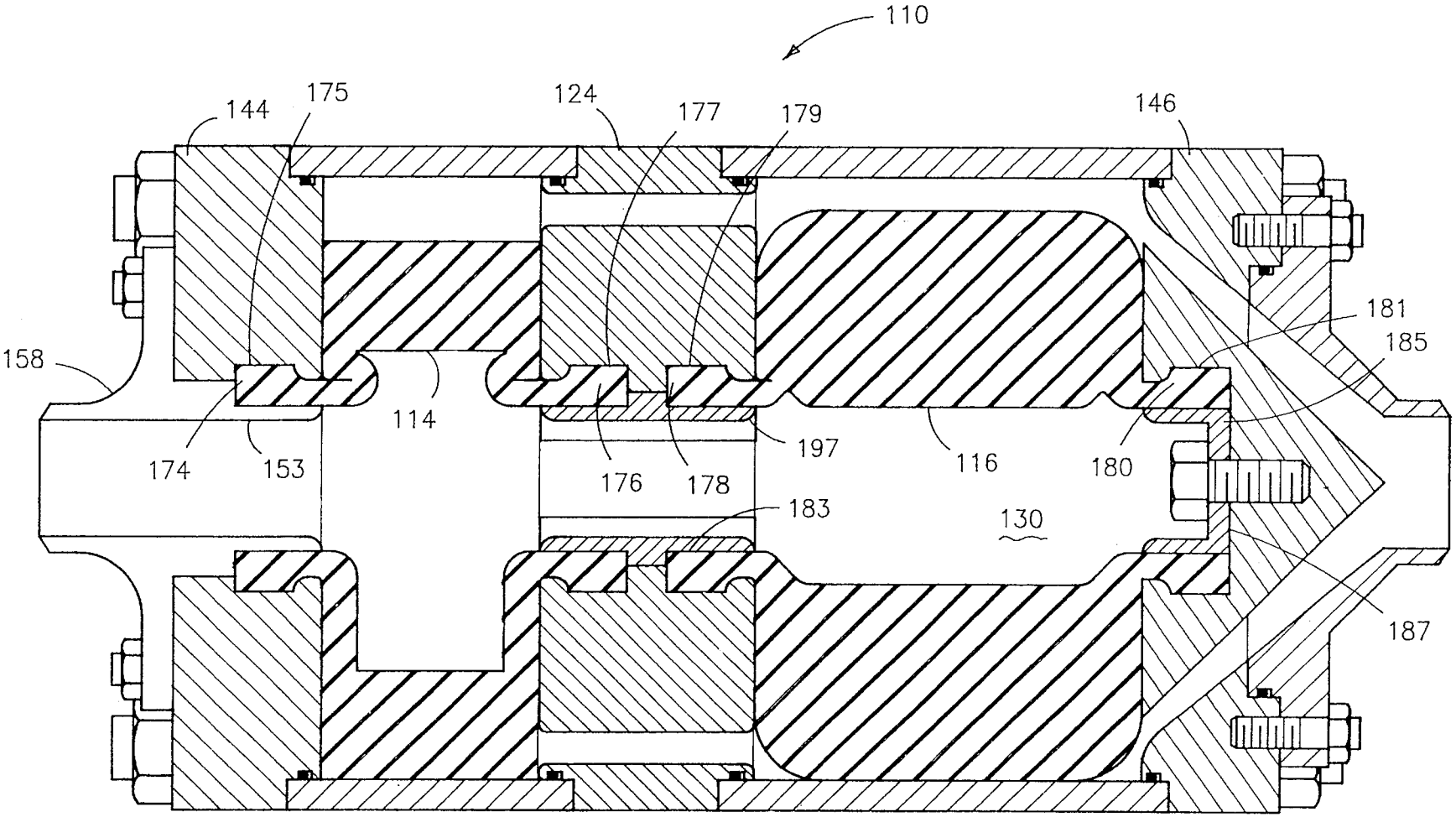
FIG. 3 is a side elevational and partially cross-sectional view of an alternative embodiment of the ejector device.

An alternative embodiment of the device is shown in FIG. 3, designated generally as 110, wherein the spring loaded seals are replaced by static seals 174, 176, 178 and 180, attached directly to rings 114 and 116. The construction of this embodiment is substantially the same as discussed above and therefore, only the alterations to the main embodiment will be described in detail.

Seals 174 and 176, and seals 178 and 180, extend from the outer annular edges of rings 114 and 116, respectively. The seals are preferably formed from the same elastomeric material as the rings and are preferably integral therewith. Seals 174 and 176 are secured in grooves 175 and 177, respectively, in end cap 144 and mid piece 124, respectively. Seals 178 and 180 are secured in grooves 179 and 181, respectively, in mid piece 124 and end cap 146, respectively. Grooves 175, 177, 179 and 181 span the inner circumference of their respective end pieces and mid piece and engage ridges extending from the end of seals 174, 176, 178 and 180.

Seal 174 is secured in groove 175 via an extended cylindrically shaped flange portion 153 of pipe connector 158, which essentially replaces the cylindrical flange of the end plate from the main embodiment. Seals 176 and 178 are secured in grooves 177 and 179 by a cylindrically shaped split gasket retainer 197. While seals 176 and 178 are positioned in grooves 177 and 179, the ridges extending from the seals extend outwardly beyond the inner circumference of the mid piece, forming a central groove 183. The cylindrically shaped split gasket retainer includes a ridge on its outer circumference which expands into this groove, due to the split nature of the gasket, for securing seals 176 and 178. Unlike the main embodiment, mid piece 124 does not include a central axial and cylindrically extending flange portion because rings 114 and 116 are secured via the seals being secured in the grooves 177, 179.

Seal 180 is secured via a dished bracket 185 which is fastened centrally to the end cap 146, within chamber 130. The wing portions of the dished bracket 185 extend axially and abut seal 180 for securing the same in groove 181. In this embodiment, end cap 146 does not include a flange portion for securing ring 116 because security is achieved through securing seal 180. End cap 146 does include a recess 187 which receives seal 180 and dished bracket 185. Ejector 110 functions substantially the same as ejector 10, previously described. It should be noted that FIG. 3 shows rings 114 and 116 in their natural position in the upper portion of the figure and in their expanded position in the lower portion of the figure.

Referring to FIG. 4 which shows the device in operation, the dual elastomeric rings 14 and 16 of ejector 10 function to provide two ejection velocities. Ring 14, because of its smaller thickness and length, provides a lower level of elastomeric energy and accordingly, a lower velocity ejection and ring 16 due to its larger thickness and length, provides higher pressure and a higher level of elastomeric energy and accordingly, a higher velocity ejection.

Ejector 10 is generally designed for use with marine vessels wherein pressurized sea water is used as the means for expanding rings 14 and 16 to store elastomeric energy and as the means for carrying the energy for launching. Consequently, because port 18 is vented to the outside, sea water also collects in chambers 28 and 30 outside rings 14 and 16, thus subjecting the outer surface of the rings to sea pressure.

In order to operate ejector 10 or 110 for achieving a lower velocity launch, water is pumped into channel 72 by pump 91 via port 19 for loading the rings 14 and 16 with elastomeric energy through a valved piping system 95, shown schematically in FIG. 4. When the water pressure in channel 72 begins to exceed sea pressure adjacent the outside of each elastomeric ring and overcomes the strength of the ring, elastomeric ring 14 will begin to expand due to its lower strength and higher elasticity, pushing sea water out of outer portions of chambers 28 and 30 (See FIG. 1) and through port 18. The pressure will be maintained in channel 72 because of the spring loading of sealing rings 74 and 76 against elastomeric ring 14, maintaining a seal, as the ring 14 expands in diameter and its length decreases or, with reference to device 110, via static seals 174, 176, 178 and 180. At a pre-determined pressure, elastomeric ring 14 will expand to a diameter which brings it into contact with the interior surface of cylindrical portion 20. At this pressure, elastomeric ring 16 will have expanded only a minimal amount because of its greater thickness giving its lower elasticity and higher strength, causing it to distort much less than ring 14 when subjected to equivalent pressures. The physical state of ring 16 during the low velocity launch is represented in FIG. 4 by the dotted lines, wherein it is shown substantially unexpanded.

With ring 14 in its expanded state and ring 16 unexpanded, and in order to fire ejector 10, a firing valve or release mechanism 90, shown schematically, is opened between the ejector and a launch tube 92, shown schematically, and the high pressure water exits the ejector under pressure and forces an article 93, e.g., a projectile, shown schematically, out of the launch tube 92 as the elastomeric rings 14 and 16 return to their original, unstressed configuration (See FIG. 1). This sequence of steps would be utilized only when a low pressure, low velocity launch is desired, because in this sequence, pressure is introduced into channel 72 only until ring 14 expands into contact with the inner surface of cylindrical portion 20. That is, for low pressure, low velocity launches, pressure is not caused to rise to a point where elastomeric ring 16 is expanded against the inner surface of cylindrical portion 22. For this low velocity, low pressure launch, the volume of water displaced by the elastomeric rings upon returning to the unstressed configuration, is equal to the volume of water required to achieve a full low pressure, low velocity launch.

In order to achieve a high pressure-high velocity launch, the procedure discussed in the previous paragraph would be followed with the exception that higher pressure via the water is developed in channel 72 for expanding elastomeric ring 16 outward until it contacts the inner surface of cylindrical portion 22, as shown in FIG. 4 entirely by solid lines. Such high pressure is maintained at least until elastomeric ring 16 expands into contact with the inner surface of cylindrical portion 22. Similar to ring 14, the pressure against the outer surface of the ring 16 and the ejection pressure, i.e., the pressure formed as a result of the injection of the water into channel 72, are isolated from each other by spring loaded sealing rings 78 and 80 or with reference to device 110, via seals 178 and 180.

For firing the ejector and launching the article, the firing valve 90 is opened, as discussed above, and as ring 16 returns to its unstressed state, shown in FIG. 1, it forces water under high pressure out port 19 and into the guiding launch tube 92 for ejecting the article 93. With this launch sequence via the expanded larger ring 16, a higher pressure is created which results in a higher exit velocity for the article being launched. However, with high pressure, high velocity launches, the full volume of water needed to effect launch is equivalent to the volume of water displaced by the expansion of ring 16. That is, the addition of the volume of water displaced by the expansion of ring 14 will not effect this launch sequence. The water in which ring 14 displaces in excess of the displacement volume required to effect a full high velocity, high pressure launch is not used.

The primary advantage of this invention is that an ejector device is provided for use in marine applications which is effective for producing variable speed ejections and which is efficiently sized. Another advantage is that an ejector device is provided for use in marine applications which incorporates the use of elastomeric energy. Still another advantage is that an ejector device is provided for use in marine applications which is economic and allows for covert operation via the quiet nature of elastomeric devices. Still another advantage is to that an ejector device is provided for use in marine vessels which uses elastomeric energy and which is capable of being a back fit and forward fit on the marine vessels.

It is apparent that there has been provided in accordance with this invention a bi-modal, elastomeric ejector which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A device for providing fluid to an article guide comprising:

a housing having an aperture therein;

at least two elastomeric devices positioned within said housing and in communication with said aperture, each said elastomeric device being adapted to store different amounts of energy;

a fluid for provision under pressure to said housing aperture for causing at least one elastomeric device to store elastomeric energy; and a valve joined to said aperture and to said article guide for controllably allowing said at least one elastomeric device to release elastomeric energy whereby said fluid receives the elastomeric energy, and travels through said housing aperture, and said valve to said article guide.

2. The device according to claim 1 wherein said at least two elastomeric devices comprise a first elastomeric device and a second elastomeric device positioned in the housing, the second elastomeric device being adapted to store more energy than the first elastomeric device for providing said fluid at a higher velocity to said article guide than the velocity at which the first device is adapted to provide said fluid.

3. The device according to claim 2 wherein the first and second elastomeric devices are cylindrically shaped to define central cavities therein, said first and second elastomeric devices are positioned in the housing such that expansion of each said elastomeric device is allowed for the storage of the elastomeric energy, and said central cavities are in communication with said housing aperture.

4. The device according to claim 3 further comprising a mid piece having an aperture therein, said first and second elastomeric devices being joined to said mid piece aperture and substantially separated by the mid piece, and said mid piece allowing communication of fluid from said first elastomeric device central cavity to said second elastomeric device central cavity through said mid piece aperture.

5. The device according to claim 1 wherein each said elastomeric device is cylindrically shaped to define a central cavity therein and two open ends, one open end being in communication with said housing aperture, and each said elastomeric device is positioned in the housing such that expansion of each said elastomeric device is allowed for the storage of elastomeric energy therein.

6. The device according to claim 5,wherein each said elastomeric device is adapted to have a greater pressure therein than that surrounding the elastomeric device, said elastomeric device expanding in response to said greater internal pressure for storing elastomeric energy, said fluid being provided to create a pressure within each said elastomeric device.

7. The device according to claim 6 further comprising a sealing means joined between each said elastomeric device and the housing for sealably separating the pressure within said elastomeric device central cavity against the pressure outside said elastomeric device, wherein the sealing means maintains a seal during the expansion of said elastomeric device.

8. The device according to claim 7 wherein the sealing means comprises spring loaded sealing rings joined between said housing and ends of said cylindrical elastomeric device.

9. The device according to claim 7 wherein the sealing means comprises integral portions of said at least two elastomeric devices, said integral portions being joined from the ends of each said elastomeric device to said housing.

10. The device according to claim 6 wherein the housing comprises:

at least two hollow cylindrical sections each having two ends, each said cylindrical section substantially enclosing at least one elastomeric device;

at least one mid piece having an aperture therein, each mid piece being positioned between ends of two cylindrical sections, each said enclosed elastomeric device being joined to said mid piece aperture;

a first end cap having said housing aperture therein, said first end cap being attached to the outer end of said joined cylindrical sections, said enclosed elastomeric device being joined to said housing aperture; and a second end cap joined to said other outer end of said joined cylindrical sections, said enclosed elastomeric device being joined to said second end cap.

11. The device according to claim 10 wherein said second end cap has a vent aperture therein positioned in communication with the volume surrounding said enclosed elastomeric device, said at least one mid piece having a vent aperture therein to allow communication between the volumes surrounding enclosed elastomeric devices in each cylindrical section.

12. The device according to claim 11 further comprising a plurality of tie rods extending from said first end cap to said second end cap for joining said housing together.

* * * * *